US009534591B2

(12) United States Patent
Roettger et al.

(10) Patent No.: US 9,534,591 B2
(45) Date of Patent: Jan. 3, 2017

(54) LINEAR COMPRESSOR BASED ON RESONANT OSCILLATING MECHANISM

(75) Inventors: Wilfred Roettger, Joinville (BR); Ingwald Vollrath, Joinville (BR); Paulo Rogério Carrara Couto, Joinville (BR); Celso Kenzo Takemori, Joinville (BR)

(73) Assignee: Whirlpool S.A., São Paulo, SP (BR)

( * ) Notice: Subject to any disclaimer, the term of this patent is extended or adjusted under 35 U.S.C. 154(b) by 204 days.

(21) Appl. No.: 14/241,721

(22) PCT Filed: Aug. 6, 2012

(86) PCT No.: PCT/BR2012/000276

§ 371 (c)(1),
(2), (4) Date: Jun. 27, 2014

(87) PCT Pub. No.: WO2013/029133

PCT Pub. Date: Mar. 7, 2013

(65) Prior Publication Data

US 2014/0301874 A1 Oct. 9, 2014

(30) Foreign Application Priority Data

Aug. 31, 2011 (BR) ..... 1104172

(51) Int. Cl.
*F04B 53/00* (2006.01)
*F04B 35/04* (2006.01)
(Continued)

(52) U.S. Cl.
CPC ..... *F04B 35/045* (2013.01); *F04B 17/04* (2013.01); *F04B 39/127* (2013.01); *F04B 53/00* (2013.01);
(Continued)

(58) Field of Classification Search
CPC ..... F04B 39/127; F04B 39/10; F04B 27/10; F04B 35/04; F04B 39/00055; F04B 39/0044; F04B 35/045; F04B 53/00; F04B 17/04; F04B 2203/04; F04B 2203/09
(Continued)

(56) References Cited

U.S. PATENT DOCUMENTS 2,322,913 A * 6/1943 Best ..... F02M 37/08 310/34
2,934,256 A * 4/1960 Lenning ..... F04B 35/045 417/274
(Continued)

FOREIGN PATENT DOCUMENTS

BR WO 2007118295 A1 * 10/2007 ..... F04B 35/045
BR WO 2013026115 A1 * 2/2013 ..... F04B 35/045
(Continued)

OTHER PUBLICATIONS

International Search Report issued by the European Patent Office on Feb. 18, 2013 in International Application No. PCT/BR2012/000276.

*Primary Examiner* — Dominick L Plakkoottam
(74) *Attorney, Agent, or Firm* — Brian J. Colandreo; Michael T. Abramson; Holland & Knight LLP

(57) ABSTRACT

The present invention refers to a linear compressor based on resonant oscillating mechanism, which is comprised by at least one resonant spring (2) at least one linear motor (3) composed of at least one fixed portion (31 ) and at least one movable portion (32), at least one piston (4) operatively associated with at least one rod (5) and at least one cylinder (6), all these elements being disposed within a housing (7), and the movable portion (32) of the linear motor (3) is physically associated with one end of the resonance spring (2) through a first coupling assembly and the rod (5) is
(Continued)

physically associated with the opposite end of the resonance spring (2) through a second coupling assembly. The linear motor (3), the cylinder (6) and the piston (4) are physically arranged within a same end of the housing (7). The rod (5) is disposed within the resonant spring (2). The piston-cylinder assembly (4, 6) is capable of acting at the distal end to the coupling end between the rod (5) to the resonant spring (2).

9 Claims, 3 Drawing Sheets

(51) Int. Cl.
*F04B 17/04* (2006.01)
*F04B 39/12* (2006.01)

(52) U.S. Cl.
CPC ..... *F04B 2203/04* (2013.01); *F04B 2203/09* (2013.01)

(58) Field of Classification Search
USPC ..... 417/44.1, 416, 417, 328, 410.1, 415
See application file for complete search history.

(56) References Cited

U.S. PATENT DOCUMENTS 2,954,917 A * 10/1960 Bayer ..... F04B 35/045 417/417
3,171,585 A * 3/1965 Gauss ..... F04B 35/045 417/417
3,250,219 A * 5/1966 McCarty ..... F02M 37/08 137/492
3,267,866 A * 8/1966 Unger ..... F04B 17/046 417/417
3,325,085 A * 6/1967 Gaus ..... F04B 35/045 417/416
3,462,136 A * 8/1969 Rumsey ..... F16F 1/326 188/268
3,588,291 A * 6/1971 Curwen ..... F04B 35/045 417/417
3,781,140 A * 12/1973 Gladden ..... H02K 33/18 310/27
3,786,834 A * 1/1974 Garland ..... F16K 15/08 137/512.1
3,810,719 A * 5/1974 Wolthers ..... F01L 25/08 417/317
4,002,935 A * 1/1977 Brauer ..... H02K 33/18 310/27
4,044,628 A * 8/1977 Jacks ..... F16F 15/1213 188/268
4,116,591 A * 9/1978 Mardell ..... F02M 51/04 310/80
4,145,936 A * 3/1979 Vincent ..... B64C 27/001 416/500
4,225,287 A * 9/1980 Vincent ..... B64C 27/001 416/145
4,416,594 A * 11/1983 Ichikawa ..... F04B 39/127 248/606
4,474,537 A * 10/1984 Dolz ..... F04B 35/045 310/35
4,568,250 A * 2/1986 Falk ..... A61M 5/14216 417/254
4,569,641 A * 2/1986 Falk ..... A61M 5/14216 310/104
4,632,645 A * 12/1986 Kawakami ..... F04B 35/045 310/27
4,636,150 A * 1/1987 Falk ..... A61M 5/14216 310/104
4,743,179 A * 5/1988 Waas ..... F04B 17/042 417/417
4,795,012 A * 1/1989 Durum ..... F16D 3/52 192/207
4,827,968 A * 5/1989 Brown ..... F04B 53/1032 137/270
4,872,767 A * 10/1989 Knapp ..... F01D 25/164 384/535
5,022,832 A * 6/1991 Lauterbach ..... F04B 39/1033 137/516.15
5,146,124 A * 9/1992 Higham ..... F16F 7/116 310/17
5,147,246 A * 9/1992 Focqueur ..... F16F 15/1213 192/207
5,222,878 A * 6/1993 Osada ..... F04B 53/08 417/366
5,597,294 A * 1/1997 McGrath ..... F04B 35/04 417/417
5,697,848 A * 12/1997 Bosley ..... F01D 5/02 415/216.1
5,797,733 A * 8/1998 Falk ..... A61M 5/14216 417/307
5,895,033 A * 4/1999 Ross ..... F16F 7/116 267/161
6,015,273 A * 1/2000 Hannagan ..... F04B 35/045 417/417
6,412,586 B1 * 7/2002 Askew ..... F01N 13/00 180/309
6,540,490 B1 * 4/2003 Lilie ..... F04B 35/045 417/416
6,585,091 B2 * 7/2003 Reinhart ..... F16F 1/34 192/203
6,622,839 B2 * 9/2003 Kundermann ..... F16D 25/0638 192/207
6,742,998 B2 * 6/2004 Kawahara ..... F04B 35/045 417/363
6,790,015 B1 * 9/2004 Song ..... F04B 35/045 417/415
6,838,788 B2 * 1/2005 Park ..... H02K 33/16 310/12.01
6,884,044 B2 * 4/2005 Lilie ..... F04B 35/045 417/363
6,960,067 B2 * 11/2005 Jung ..... F04B 35/045 310/14
6,966,760 B1 * 11/2005 Radue ..... F04B 17/042 417/205
7,215,047 B2 * 5/2007 Lilie ..... H02K 33/16 310/15
7,316,547 B2 * 1/2008 Lilie ..... F04B 35/045 417/415
7,717,792 B2 * 5/2010 Chaudhari ..... F16D 3/77 464/99
7,988,430 B2 * 8/2011 Kang ..... F04B 35/045 417/416
7,993,109 B2 * 8/2011 Rush ..... A61M 5/14216 417/199.2
8,028,409 B2 * 10/2011 Hanes ..... F04B 35/045 29/446
8,029,250 B2 * 10/2011 Rush ..... A61M 5/14216 417/321
8,033,795 B2 * 10/2011 Dainez ..... F04B 35/045 318/687
D658,681 S * 5/2012 Takemori ..... D15/7
D658,682 S * 5/2012 Takemori ..... D15/9
D658,683 S * 5/2012 Takemori ..... D15/9
8,303,273 B2 * 11/2012 Kang ..... F04B 39/0088 417/416
8,360,749 B2 * 1/2013 Morrone ..... F04B 35/045 29/890.035
8,794,934 B2 * 8/2014 Kang ..... F04B 17/04 310/12.15
8,998,589 B2 * 4/2015 Lilie ..... F04B 35/045 417/410.1
9,004,885 B2 * 4/2015 Ki ..... F04B 35/045 417/363
2002/0164255 A1 * 11/2002 Burr ..... F04B 45/047 417/363
2003/0017064 A1 * 1/2003 Kawahara ..... F04B 35/045 417/417

(56) References Cited

U.S. PATENT DOCUMENTS

2004/0022651 A1* 2/2004 Hashimoto ..... F04B 17/046 417/417
2004/0074700 A1* 4/2004 Lilie ..... F04B 35/045 184/6.16
2004/0115076 A1* 6/2004 Lilie ..... F04B 35/045 417/416
2004/0145247 A1* 7/2004 Lilie ..... H02K 33/02 310/156.01
2004/0156730 A1* 8/2004 Lilie ..... F04B 35/045 417/363
2004/0247457 A1* 12/2004 Kim ..... F04B 35/045 417/312
2004/0247466 A1* 12/2004 Lee ..... F04B 25/005 417/415
2005/0025638 A1* 2/2005 Buffet ..... F04B 17/046 417/416
2005/0089417 A1* 4/2005 Chordia ..... F04B 7/06 417/415
2005/0123422 A1* 6/2005 Lilie ..... F04B 35/045 417/416
2005/0135946 A1* 6/2005 Kang ..... F04B 35/045 417/416
2005/0214140 A1* 9/2005 Lee ..... F04B 35/045 417/416
2005/0226733 A1* 10/2005 Puff ..... F04B 35/045 417/63
2005/0260086 A1* 11/2005 Park ..... F04B 35/045 417/417
2006/0008366 A1* 1/2006 Kingsford ..... F04B 9/02 417/417
2006/0018771 A1* 1/2006 Song ..... F04B 35/045 417/416
2006/0024181 A1* 2/2006 Kim ..... F04B 35/045 417/417
2006/0057000 A1* 3/2006 Hyeon ..... F04B 35/045 417/415
2006/0127249 A1* 6/2006 Lilie ..... F04B 35/045 417/417
2006/0171814 A1* 8/2006 Dainez ..... F04B 35/045 417/44.1
2006/0220473 A1* 10/2006 Ueda ..... H02K 33/16 310/12.25
2007/0041855 A1* 2/2007 Hansen ..... F04B 35/045 417/417
2007/0041856 A1* 2/2007 Hansen ..... F04B 49/14 417/417
2007/0110600 A1* 5/2007 Park ..... F04B 35/045 417/417
2007/0152517 A1* 7/2007 Park ..... H02K 33/16 310/15
2007/0158945 A1* 7/2007 Annen ..... H02K 7/1884 290/1 A
2007/0158946 A1* 7/2007 Annen ..... F02B 71/04 290/1 R
2007/0158947 A1* 7/2007 Annen ..... F02B 63/04 290/1 R
2007/0159128 A1* 7/2007 Dainez ..... F04B 35/045 318/687
2007/0177984 A1* 8/2007 Berwanger ..... F04B 49/06 417/44.1
2008/0008607 A1* 1/2008 Schade ..... F04B 35/045 417/410.1
2008/0019852 A1* 1/2008 Brand ..... F04B 35/045 417/415
2008/0075610 A1* 3/2008 Bonniface ..... F04B 35/045 417/417
2008/0089796 A1* 4/2008 Schade ..... F04B 35/045 417/417
2008/0112829 A1* 5/2008 Hell ..... F04B 35/045 417/546
2008/0134833 A1* 6/2008 Lilie ..... F04B 35/045 74/581
2008/0245094 A1* 10/2008 Orum ..... F04B 35/045 62/426
2008/0267798 A1* 10/2008 Liu ..... F04B 35/045 417/416
2009/0081049 A1* 3/2009 Tian ..... F04B 35/045 417/18
2009/0081058 A1* 3/2009 Ishibashi ..... F04B 35/045 417/417
2009/0120967 A1* 5/2009 Bensley ..... F04B 9/02 222/333
2009/0129955 A1* 5/2009 Schubert ..... F04B 35/045 417/417
2009/0280015 A1* 11/2009 Lillie ..... F04B 35/045 417/416
2010/0147758 A1* 6/2010 Hans-Georg ..... F04B 49/065 210/198.2
2010/0296951 A1* 11/2010 Lee ..... F04B 35/045 417/417
2010/0310393 A1* 12/2010 Lee ..... H02K 33/16 417/417
2011/0008191 A1* 1/2011 Lilie ..... F04B 35/045 417/410.1
2011/0044831 A1* 2/2011 Cunningham ..... F04D 1/063 417/410.1
2011/0056235 A1* 3/2011 Hoshino ..... F04B 35/045 62/498
2011/0058966 A1* 3/2011 Cunningham ..... F04D 13/10 417/410.1
2012/0034119 A1* 2/2012 Du ..... F04B 3/00 417/523
2012/0251359 A1* 10/2012 Neelakantan ..... F04B 17/046 417/416
2013/0121855 A1* 5/2013 Lilie ..... F04B 35/045 417/363
2014/0007765 A1* 1/2014 Takemori ..... F04B 35/045 92/137
2014/0216064 A1* 8/2014 Champagne ..... F25B 9/14 62/6
2014/0234137 A1* 8/2014 Roman ..... F04B 35/045 417/363
2014/0234145 A1* 8/2014 Roman ..... F04B 35/045 417/481
2014/0241911 A1* 8/2014 Roman ..... F04B 35/045 417/328
2014/0301874 A1* 10/2014 Roettger ..... F04B 35/045 417/437
2014/0340003 A1* 11/2014 Silvia ..... F04B 35/045 318/128
2015/0040752 A1* 2/2015 Roman ..... F04B 39/0022 92/172
2015/0219095 A1* 8/2015 Muhle ..... F04B 39/0292 92/169.1
2015/0226195 A1* 8/2015 Mallampalli ..... F04B 49/06 417/44.1
2015/0226200 A1* 8/2015 Beers ..... F04B 35/045 417/416
2015/0226201 A1* 8/2015 Beers ..... F04B 35/045 417/363
2015/0226202 A1* 8/2015 Beers ..... F04B 39/0005 417/363
2015/0226210 A1* 8/2015 Barito ..... F04B 35/045 417/415

FOREIGN PATENT DOCUMENTS

BR WO 2013029133 A1 * 3/2013 ..... F04B 35/045
DE 15 03 416 A1 1/1970
DE 30 30 711 A1 2/1981
EP 1 985 857 A2 10/2008
GB WO 9428306 A1 * 12/1994 ..... F04B 35/04
KR WO 2004081406 A2 * 9/2004 ..... F04B 35/045
NZ WO 2004106737 A1 * 12/2004 ..... F04B 35/045
WO 2006081642 A2 8/2006

* cited by examiner

LINEAR COMPRESSOR BASED ON RESONANT OSCILLATING MECHANISM

RELATED APPLICATIONS

The subject application is a U.S. National Stage Application of International Application No. PCT/BR 2012/000276, filed on 6 Aug. 2012, which claims the priority of Brazil Patent Application No.:PI 1104172-2, filed on 31 Aug. 2011, the contents of which are herein incorporated by reference in its entirety.

FIELD OF THE INVENTION

The present invention refers to a linear compressor based on resonant oscillating mechanism, in particular based on a mass-spring resonant system whose electric motor and the cylinder-piston assembly are connected to opposite ends of a resilient element, but arranged in a same distal end of the compressor in question.

BACKGROUND OF INVENTION

Oscillatory systems and mechanisms of the mass-spring type comprise coupling a measurable body weight to the end of a spring capable of resilient deformation, the other end of the spring being coupled to an usually fixed reference point. In these types of systems and mechanisms, the mass can be displaced from its equilibrium position (by an external force), causing deformation in the spring (in the line of its length). Once the external force is removed, the mass tends to return to its equilibrium position (due to the spring force) by executing an oscillatory motion.

From the functional point of view, one of the ends of the spring can be coupled to mass and the other end of the spring can be coupled to an external power source. Thus, the external power source begins to integrate the system/mechanism, so that the movement of the mass becomes oscillating and constant.

In resonant arrangements, it is aimed that the system/mechanism to work at maximum efficiency, where the mass oscillates at maximum amplitude from an external minimum force at certain frequencies, which are known as "resonance frequencies".

The current state of the art provides or the application of physical concepts in the construction of linear compressors.

Some functional examples of linear compressors based on resonant oscillating mechanisms are described in the document PI 0601645-6. Such functional examples refer to compressors wherein the piston (which slides within a cylinder, effecting the compression of a working fluid) comprises the "mass", and the linear motor (mainly composed of a fixed stator and a moving magnet) comprises the "source of strength." With reference to the "spring" (which comprises the coupling element between the piston and the magnet of the linear motor) it may comprise a body with resilient characteristics and capable of resonant linear vibration. Described herein are different types of linear assembly of compressors based on the same oscillating resonant concept/functional principle. In any case, all the functional examples described in the document PI 0601645-6 provide embodiments in which the linear motor/piston oscillate, at a resonant manner, at the opposite ends of the spring (or of the body having the function of the spring).

A detailed construction (based on one of the functional examples described in the document PI 0601645-6) is best seen in FIG. 1 which illustrates a linear compressor (based on resonant oscillating mechanism) belonging to the current state of the art.

Thus, the compressor CP illustrated in FIG. 1 includes a linear motor ML and a piston PT (which slides within a cylinder CL), both coupled to a resonant spring MR. The magnet of the linear motor ML is coupled to one end of the ends of the resonant spring MR and the piston PT is located coupled to the opposite end of the resonant spring ML.

All the examples described in the document PI 0601645-6 (also including the example illustrated in FIG. 1) are functional and achieve the objectives to which they are proposed. However, these same examples have a ratio of length/capacity that is subject to optimization.

As is well known to those skilled in the subject, one of the factors which determines the ability of a linear compressor comprises the path of travel of the piston within the cylinder (volume useful for the compression of a working fluid). In the case of examples so far cited and illustrated (and other similar constructions and belonging to the current state of the art), the path of travel of the piston is proportional to the length of the compressor as a whole, thus optimizing the compressor capacity involves the increase in length. Thus, it is noted that the ratio of length/capacity of the linear compressors belonging to the current state of the art prevents the construction of a miniaturized compressor with great capacity of compression.

The current state of the art further comprises linear compressors whose linear motor is arranged among a resonant assembly (springs associated with each other to perform the function of a single resonant spring).

An example of such constructiveness is described in the document WO 2007/098970. In this paper, the linear compressor is also based on oscillating resonant system/mechanism.

In this construction, there is provided a drive motor unit disposed between two resonant springs, wherein only one of these resonant springs is coupled to the piston-cylinder assembly. In this case, the linear motor provides a type of piston connected to a rod which, in turn, is coupled to the piston.

Anyway, the aforementioned limitation (limitation related on the ratio of length/capacity) is also present in this constructiveness.

Based on all the context explained above, it is evident to observe the need of development of a linear compressor free of limitation imposed by its ratio of length/capacity.

Objectives of the Invention

Thus, it is one of the goals of the present invention to provide a linear compressor based on resonant oscillating mechanism capable of dimensional miniaturization and maintenance of functional capacity.

It is another objective of the present invention to disclose a linear compressor whose path of travel of the piston (inside the cylinder) is not fully related to the length of the compressor as a whole.

It is still another objective of the present invention to provide a linear compressor based on resonant oscillating mechanism which allows the use of a rod of greater length and flexibility, and therefore, which minimizes the existing cross efforts between the piston and cylinder.

SUMMARY OF THE INVENTION

These and other objects of the invention disclosed herein are fully achieved by the linear compressor based on the resonant oscillating mechanism disclosed herein, which comprises at least one resonant spring, at least one linear motor comprising at least one fixed portion and at least one movable portion, at least one piston operatively associated with at least one rod and at least one cylinder, all these elements being disposed within a housing. The movable portion of the linear motor is physically associated with one of the ends of the resonant spring through a first coupling assembly and the rod is physically associated with the opposite end of the resonant spring by a second coupling assembly.

The linear motor, the piston and cylinder are physically disposed within a same end of the housing, and the rod is disposed within the resonant spring and the piston-cylinder assembly is capable of acting on the distal end to the coupling end between the rod and the resonant spring.

According to the concepts of the present invention, the rod passes through the resonant spring.

Also according to the concepts of the present invention, the movable portion of the linear motor and the piston oscillates reciprocally in opposite directions. Preferably, the piston-cylinder assembly is arranged within the perimeter defined by the linear motor, in particular within the perimeter defined by the movable portion of the linear motor.

In the preferred form and also in accordance with the concepts of the present invention, it should be noted that the linear compressor further comprises at least one sensing device cooperatively associated with the flexible rod. This sensing device is basically comprised of at least one fixed component, at least one movable component and at least one connecting body, and at least one of the components is subject to electromagnetic excitation proportional to the distance between them.

In this sense, the movable component is physically associated with the flexible rod by means of a connecting body, namely, the connecting body connects the end of the flexible rod to the movable component.

Preferably, the sensing device is dimensioned such that it generates a maximum oscillation of a measurable signal when of the closest approach between the components.

BRIEF DESCRIPTION OF FIGURES

The present invention will be disclosed in details based on the figures listed below, including.

DETAILED DESCRIPTION OF THE INVENTION

According to the concepts and objectives of the present invention, it is described a linear compressor based on a resonant oscillating mechanism (in particular, based on a resonant mass-spring system/mechanism) where the piston-cylinder assembly is provided spatially at the same end where the linear motor is housed within the compressor (the same distal end of the linear compressor).

These characteristics are achieved mainly by the fact that the connecting rod (or rod, or even flexible rod) is folded in relation to "its" end of oscillation (one end of the resonant spring), that is, the connecting rod is coupled to a end of the ends of the resonant spring but is arranged to traverse the aforesaid resonant spring (differently from what occurs in the linear compressors belonging to the current state of the art), being able to actuate the piston (of the piston-cylinder assembly) at the opposite end of the resonant spring.

With this, the "path of travel" of the piston (inside the cylinder) can be optimized without the compressor has its dimensions (length) elongated.

This arrangement also allows the use of a connecting rod (element responsible for the transmission of linear movement of the linear motor to the piston) of greater length and, consequently, a greater transversal flexibility. This particular feature being responsible for minimizing the transversal forces between piston and cylinder, and thus, generate less friction between them, resulting in greater durability to the linear compressor as a whole.

Thus, it is possible to obtain a linear compressor dimensionally smaller than the linear compressors belonging to the current state of the art, but with equivalent capacity between them. That is, the present invention provides a linear compressor susceptible to functional miniaturization.

Figure 3:
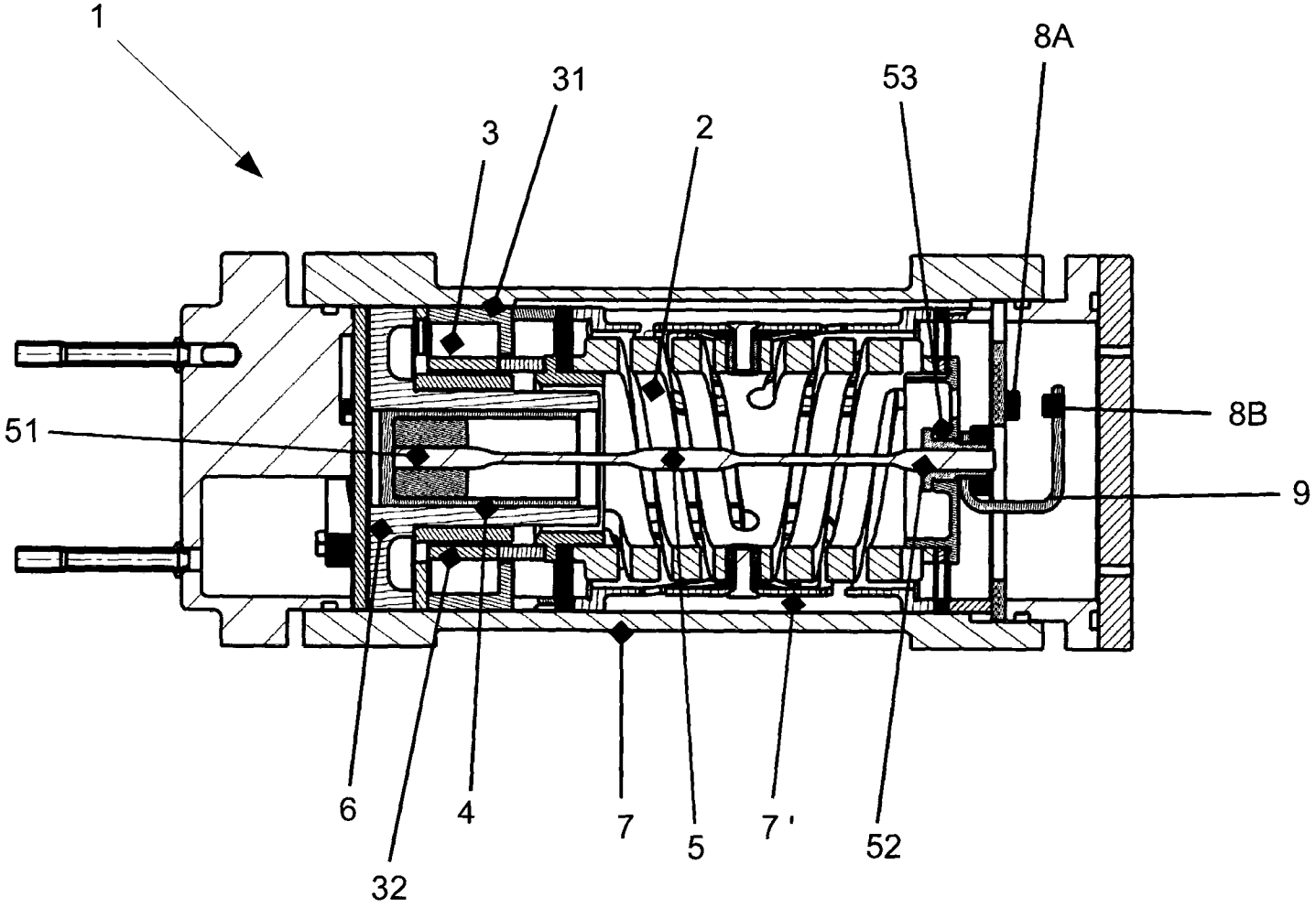
FIG. 3 shows a schematic section of the preferred embodiment of the linear compressor disclosed herein.

Therefore, and in accordance with a preferred construction of the present invention (which is illustrated in FIG. 3), the linear compressor (hereinafter referred to simply as a compressor 1) basically consists of a resonant spring 2, by a linear motor 3 by a piston 4 and by a cylinder 6, all these elements being disposed within a housing 7 which is essentially tubular.

Figure 1:
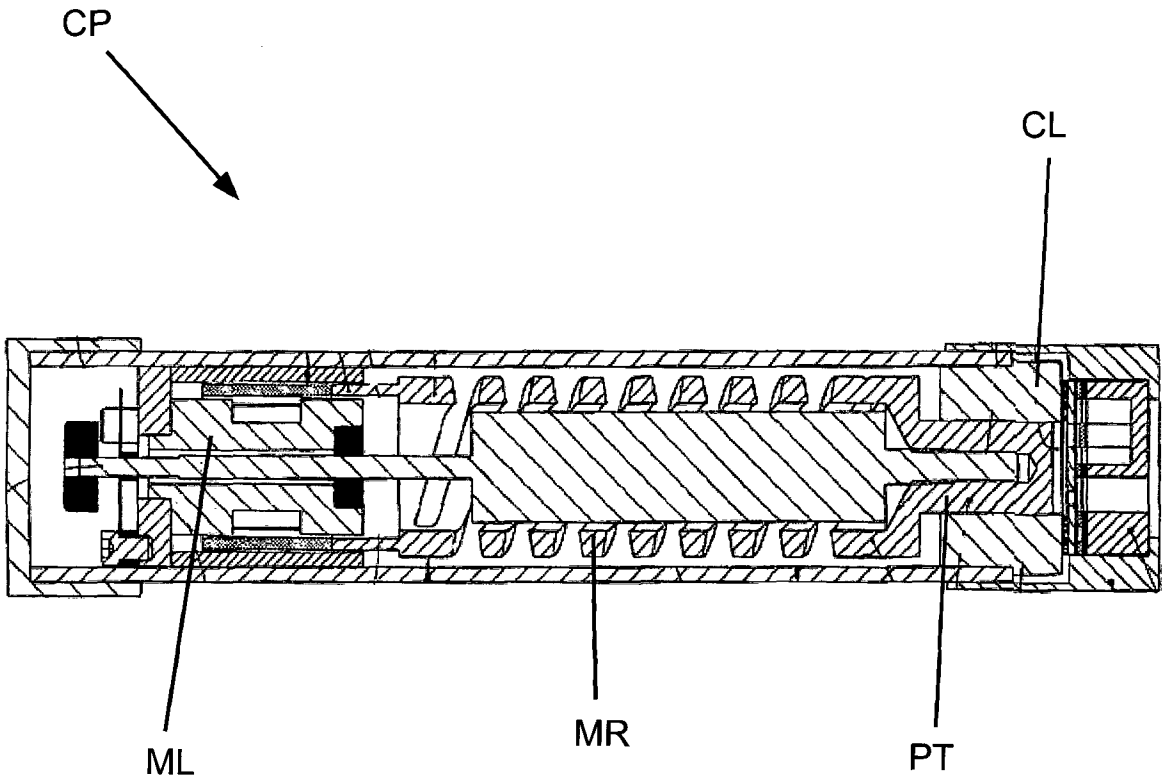
(PRIOR ART) FIG. 1
FIG. 1 shows an exemplification of linear compressor belonging to the prior art.
Figure 2:
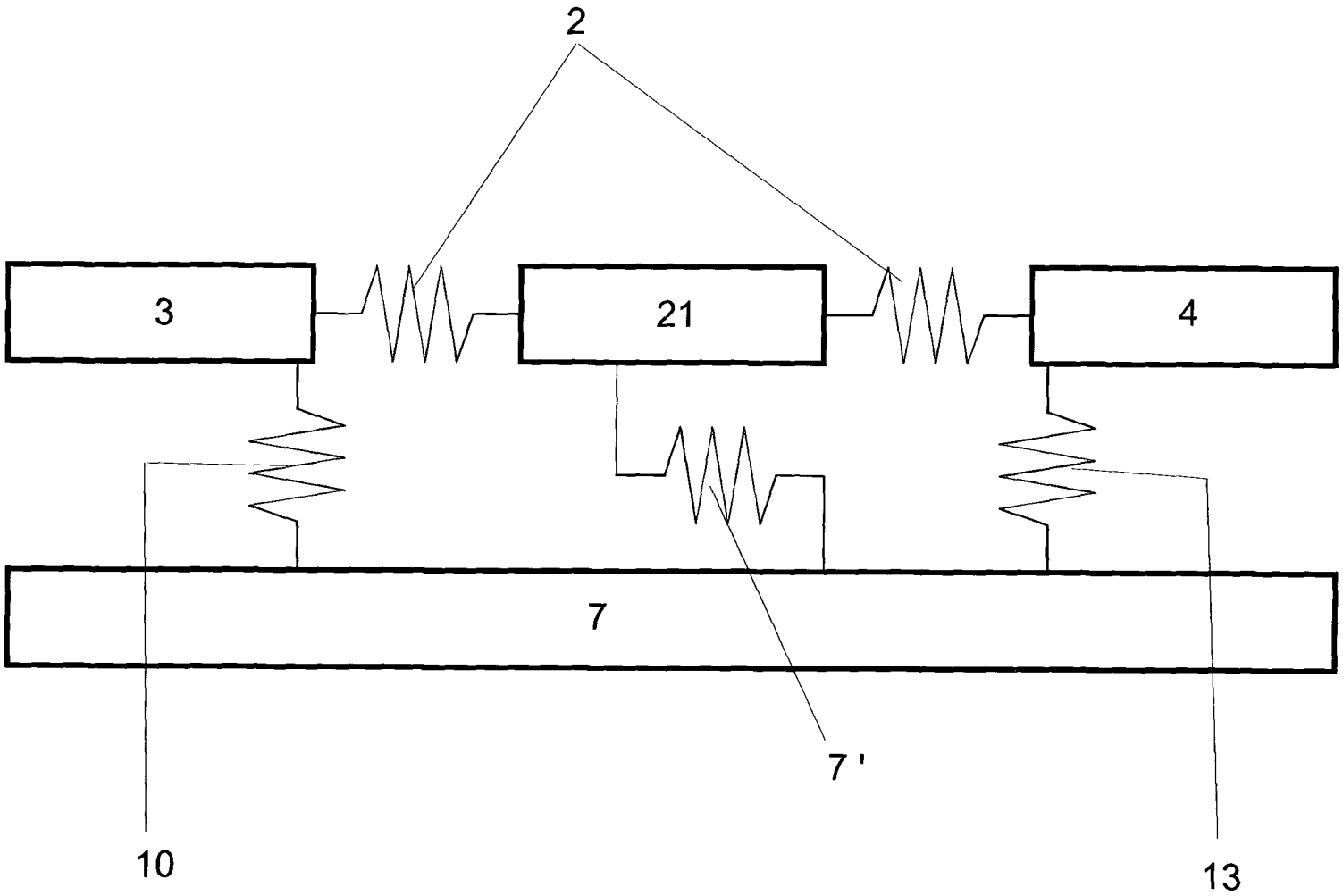
FIG. 2 illustrates a block diagram of the resonant oscillating mechanism of the linear compressor of the present invention.

The resonant spring 2 comprises a helical metal body, with characteristics of mechanical resilience. The resonant spring 2 is preferably attached to an elastic axial support 7' (which is fixed to the housing 7 of the compressor) through its neutral region 21 (region, usually central, which has no oscillating motion). Further, according to FIG. 2, the linear motor 3 is preferably attached to an elastic axial support 10 (which is fixed to the housing 7 of the compressor) and the piston 4 is preferably attached to an elastic axial support 13 (which is fixed to the housing 7 of the compressor).

The linear motor 3 is mainly composed of a fixed portion 31 (stator—coil assembly) and a movable portion 32 (cursor). The fixed portion 31 is fixed inside the housing 7, while the movable portion is attached to one of the ends of the resonant spring 2. In particular, the movable portion 32 of the linear motor 3 is fixed at one end of the resonant spring 2 by a coupling ring, a support body and a set of flat springs.

The cylinder 6 is fixed to the housing 7, being disposed within the area defined by the movable portion 32 of the linear motor 3.

The piston 4 is able to be reciprocally moved within the cylinder 6. The piston 4 comprises an essentially cylindrical and tubular body having one of the ends (working end) closed. It is provided a flexible rod 5 functionally connected to the piston 4.

The flexible rod 5 (which comprises a thin body provided with two connection ends 51 and 52) connects the piston 4 to one of the ends of the resonant spring 2, in particular the end opposite the coupling end of the movable portion 32 of the motor linear 3. In this regard, it is also observed that the flexible rod 5 has its end 52 connected to a coupling body 53, which is centrally fixed to a supporting body, which in turn is fixed to a set of flat springs. The abovementioned assembly of flat springs is also fixed at one end of the resonant spring 2.

The main inventive aspect of the present invention with respect to the current state of the art consists of the fact that the flexible rod 5, instead of being stretched in the direction of the resonant oscillating movement of the resonant spring 2 (direction distally opposite to the position of the linear motor 3) is "folded" to the same end where the linear motor 3 is located, that is, the flexible rod 5 is stretched in the direction opposite to the direction of the resonant oscillating movement of the second resonant spring 2.

To this end, the flexible rod 5 passes through the interior of said resonant spring 2. Thus, and as previously described, the flexible rod 5 has its end 52 coupled (even indirectly) to one of the ends of the resonant spring 2, and has its other end 51 connected to the piston 4, which is arranged at the same end wherein the linear motor 3 is arranged (within the housing 7 of the linear compressor in question).

The linear compressor based on the resonant oscillating mechanism further comprises, in a preferred embodiment, a sensing device cooperatively associated with the flexible rod 5.

The sensing device is primarily responsible for measuring the positioning (along the course of action) of said flexible rod 5, and therefore, by measuring the positioning and/or speed of the piston 4 within the cylinder 6. Thus, the device of the sensing is comprised of a fixed component 8A, by a movable component 8B and by a connecting body 9.

At least one of the components 8A and 8B is subject to electromagnetic excitation proportional to the distance between both. In this sense, the sensing device herein treated consists of a sensing device based on electromagnetism.

Still preferably, the fixed component 8A comprises a Hall sensor (electronics component already described in technical bibliography), or besides that, a metal coil. Also preferably, the movable component 8B comprises a magnet or a magnetic metal body.

According to the preferred construction of the linear compressor based on resonant oscillating mechanism, the movable component 8B is physically associated with the flexible rod 5 by means of a connecting body 9, which is preferably comprised of a rod of profile analogous to the letter "U". In this sense, the connecting body 9 is connected to the end 52 of the flexible rod 5 (end opposite to the end wherein the piston 4 is arranged).

For this same purpose, the fixed component 8A is fixedly disposed to a static portion or static support, existing inside the compressor 1, wherein this static portion, or static support distally opposite to the end where the piston-cylinder assembly is located.

Thus, as the piston 4 (driven by the flexible rod 5) enters the cylinder 6, the components 8A and 8B tend to get close, and at least one of these elements produces a signal (preferably electric) that is measurable and has intensity (amplitude) proportional to the distance between them. The same occurs when the components 8A and 8B move away, that is, it is also generated a measurable signal with intensity proportional to the distance between both components.

Preferably, the sensing device is dimensioned so as to generate a maximum oscillation of a measurable signal when of the closest approach between the components 8A and 8B.

Having described an example of a preferred embodiment of the concept disclosed herein, it should be understood that the scope of the present invention encompasses other possible variations, which are limited solely by the wording of the claims, where the possible equivalent arrangements included.

The invention claimed is:

1. Linear compressor based on oscillating resonant mechanism, comprising:
   - at least one resonant spring (2), at least one linear motor (3) composed of at least one fixed portion (31) and at least one movable portion (32), at least one piston (4) operatively associated with at least a flexible rod (5) formed in a single unitary piece, and at least one cylinder (6), wherein all these elements are disposed within a housing (7);
   - the movable portion (32) of the linear motor (3) is fixed at one of the ends of the resonant spring (2) through a first coupling assembly;
   - the flexible rod (5) is fixed at the opposite end of the resonant spring (2) via a second coupling assembly;
   - the linear compressor (1) being CHARACTERIZED in that:
   - the linear motor (3), the cylinder (6) and the piston (4) are arranged within a same end of the housing (7);
   - the flexible rod (5) is disposed within and passes through the resonant spring (2); and
   - the piston (4) and the cylinder (6) are capable of acting at a distal end to a second coupling end between the flexible rod (5) to the resonant spring (2).

2. Linear compressor according to claim 1, CHARACTERIZED in that the movable portion (32) of the linear motor (3) and the piston (4) oscillate in mutually opposite sense.

3. Linear compressor according to claim 1, CHARACTERIZED in that the piston (4) and the cylinder (6) are arranged within the perimeter defined by the linear motor (3).

4. Linear compressor according to claim 3, CHARACTERIZED in that the piston (4) and the cylinder (6) are arranged within the perimeter defined by the movable portion (32) of the linear motor (3).

5. Linear compressor according to claim 1, CHARACTERIZED in that it further comprises at least one sensing device cooperatively associated with the flexible rod (5).

6. Linear compressor according to claim 5, CHARACTERIZED in that the sensing device is basically comprised of at least one fixed component (8A), at least one movable component (8B) and at least one connecting body (9).

7. Linear compressor according to claim 6, CHARACTERIZED in that at least one of the fixed component (8A) and the movable component (8B) is subject to electromagnetic excitation proportional to the distance between them.

8. Linear compressor according to claim 6, CHARACTERIZED in that the movable component (8B) is fixed at the flexible rod (5) via the at least one connecting body (9); the at least one connecting body (9) connecting an end (52) of the flexible rod (5) to the movable component (8B).

9. Linear compressor according to any one of claims 6 or 8, CHARACTERIZED in that the sensing device is sized to generate a top peak signal at the closest approach between the fixed component (8A) and the movable component (8B).

* * * * *